US007387501B2

(12) United States Patent
Hirota

(10) Patent No.: US 7,387,501 B2
(45) Date of Patent: Jun. 17, 2008

(54) CONTROL VALVE FOR VARIABLE DISPLACEMENT COMPRESSOR

(75) Inventor: Hisatoshi Hirota, Tokyo (JP)

(73) Assignee: TGK Co., Ltd.,, Tokyo (JP)

( * ) Notice: Subject to any disclaimer, the term of this patent is extended or adjusted under 35 U.S.C. 154(b) by 424 days.

(21) Appl. No.: 11/076,853

(22) Filed: Mar. 11, 2005

(65) Prior Publication Data

US 2005/0201866 A1 Sep. 15, 2005

(30) Foreign Application Priority Data

Mar. 12, 2004 (JP) ..... 2004-070980

(51) Int. Cl.
*F04B 1/26* (2006.01)
*F04B 1/12* (2006.01)
*F04B 27/08* (2006.01)

(52) U.S. Cl. ..... 417/222.2; 417/269; 417/270; 417/295

(58) Field of Classification Search ..... 417/222.2, 417/270, 295; 384/49
See application file for complete search history.

(56) References Cited

U.S. PATENT DOCUMENTS 6,439,858 B1 * 8/2002 Kume et al. ..... 417/222.2
6,585,602 B2 * 7/2003 Cermak et al. ..... 464/167

FOREIGN PATENT DOCUMENTS

EP 1 099 578 A1 5/2001
EP 1 106 829 A2 6/2001
JP 06-346845 12/1994
JP 07-027049 1/1995

OTHER PUBLICATIONS

Japanese Unexamined Patent Publication No. 9-268974, Oct. 14, 1997 (Abstract only).
Japanese Unexamined Patent Publication No. 6-346845, Dec. 20, 1994 (Abstract only).
European Search Report dated Nov. 16, 2006, Application No. 05004036.9-1267.

* cited by examiner

*Primary Examiner*—Devon Kramer
*Assistant Examiner*—Patrick Hamo
(74) *Attorney, Agent, or Firm*—Westerman, Hattori, Daniels & Adrian, LLP.

(57) ABSTRACT

To provide a control valve which is capable of maintaining the minimum operation of a variable displacement compressor, by causing a valve section thereof to be fully opened, irrespective of the expanded or compressed state of a bellows, even when the suction pressure of the compressor is high. In the control valve for a variable displacement compressor, a bellows is disposed between a pressure-sensing piston and a core in a pressure-sensing chamber, and a pressing force-transmitting member which is fixed to a plunger is interposed between the pressure-sensing piston and the bellows. Then, a spring which urges the pressing force-transmitting member toward a valve section is disposed between the pressing force-transmitting member and the bellows. As a result, even if the bellows contracts due to high suction pressure Ps, the pressing force-transmitting member is held in a state being urged toward the valve section by the spring, which causes a valve element to be pushed upward via the pressure-sensing piston, to make the valve section fully open, whereby the minimum operation of the compressor can be maintained.

7 Claims, 7 Drawing Sheets

CONTROL VALVE FOR VARIABLE DISPLACEMENT COMPRESSOR

CROSS-REFERENCES TO RELATED APPLICATIONS, IF ANY

This application claims priority of Japanese Application No. 2004-070980 filed on Mar. 12, 2004 and entitled "CONTROL VALVE FOR VARIABLE DISPLACEMENT COMPRESSOR".

BACKGROUND OF THE INVENTION (1) Field of the Invention

The present invention relates to a control valve for a variable displacement compressor, and more particularly to a control valve for a variable displacement compressor which is suitable for controlling discharging capacity of refrigerant of a variable displacement compressor for an automotive air conditioner.

(2) Description of the Related Art

A compressor used in a refrigeration cycle of an automotive air conditioner is driven by an engine whose rotational speed varies depending on a traveling condition of the vehicle, and hence incapable of performing rotational speed control. To eliminate the inconvenience, a variable displacement compressor capable of changing the discharge amount of refrigerant is generally employed so as to obtain an adequate refrigerating capacity without being constrained by the rotational speed of the engine.

In a typical variable displacement compressor, a wobble plate is disposed within a crankcase formed gastight, such that the inclination angle thereof can be changed, and driven by the rotational motion of a rotational shaft, for performing wobbling motion, and pistons caused to perform reciprocating motion in a direction parallel to the rotational shaft by the wobbling motion of the wobble plate draw refrigerant from a suction chamber into associated cylinders, compress the refrigerant, and then discharge the same into a discharge chamber. In doing this, the inclination angle of the wobble plate can be varied by changing the pressure in the crankcase, whereby the stroke of the pistons is changed for changing the discharge amount of the refrigerant. The control valve for a variable displacement compressor provides control to change the pressure in the crankcase.

In general, the control valve for variably controlling the displacement of the compressor introduces part of refrigerant discharged at discharge pressure Pd from the discharge chamber into the crankcase formed gastight, and controls pressure Pc in the crankcase through control of the amount of refrigerant thus introduced. The amount of introduced refrigerant is controlled according to suction pressure Ps in the suction chamber. That is, the control valve for a variable displacement compressor senses the suction pressure Ps, and controls the flow rate of refrigerant introduced at discharge pressure Pd from the discharge chamber into the crankcase, so as to maintain the suction pressure Ps at a constant level.

To this end, the control valve for a variable displacement compressor is equipped with a pressure-sensing section for sensing the suction pressure Ps, and a valve section for causing a passage leading from the discharge chamber to the crankcase to open and close according to the suction pressure Ps sensed by the pressure-sensing section. Further, a type of the control valve for a variable displacement compressor which is capable of freely externally setting a value of suction pressure Ps to be assumed at the start of the variable displacement operation is equipped with a solenoid that enables configuration of settings of the pressure-sensing section by external electric current.

By the way, conventional control valves for variable displacement compressors which can be externally controlled include a type for controlling a so-called clutchless variable displacement compressor that is configured such that an engine is directly connected to a rotational shaft on which a wobble plate is fitted, without providing a solenoid clutch between the engine and the rotational shaft for execution and inhibition of transmission of a driving force of the engine (e.g. Japanese Unexamined Patent Publication (Kokai) No. H06-346845).

This control valve comprises a valve section causing a passage communicating between a discharge chamber and a crankcase to be opened and closed, a bellows as a pressure-sensing section, which is integrally connected to the valve element of the valve section, for causing the valve section to operate in the opening direction as the suction pressure Ps becomes lower, and a solenoid for generating an electromagnetic force causing the valve section to operate in the closing direction with the bellows being fixedly attracted to a movable core thereof, the valve section, the bellows, and the solenoid being arranged in this order. Therefore, when the solenoid is not energized, the valve section is basically fully open, whereby pressure Pc in the crankcase can be maintained at a level close to the discharge pressure Pd. This causes the wobble plate to become substantially at right angles to the rotational shaft, enabling the variable displacement compressor to operate with the minimum capacity. Thus, the discharging capacity of refrigerant can be substantially reduced to approximately zero even though the engine is directly connected to the rotational shaft, whereby the solenoid clutch can be dispensed with.

However, the above-described conventional control valve for a variable displacement compressor suffers from the problem that due to direct transmission of the expanding and contracting motion of the bellows to the valve element, the valve element is moved in the valve-opening direction by contraction of the bellows, particularly in the case where due to a heavy refrigeration load, the suction pressure Ps is high, e.g. when the outside temperature is high. This prevents the valve section from being fully opened even though the solenoid is not energized.

SUMMARY OF THE INVENTION

The present invention has been made in view of the above-described points, and an object thereof is to provide a control valve which is capable of maintaining the minimum operation of a variable displacement compressor, by causing a valve section of the control valve to be fully opened, irrespective of the expanded or compressed state of a bellows, even when the suction pressure of the compressor is high.

To solve the above problem, the present invention provides a control valve for a variable displacement compressor, the control valve being mounted in the variable displacement compressor, for varying a discharge amount of refrigerant by controlling a pressure in a crankcase of the compressor, comprising: a body that has a refrigerant passage formed therethrough, a valve section that includes a valve element that moves to and away from a valve seat formed in the body so as to be operable when part of refrigerant discharged from the variable displacement compressor is allowed to flow into the crankcase, to adjust a flow rate of the part of refrigerant, and a shaft axially slidably supported in the body and at the same time axially supporting the valve element, a solenoid that includes a core fixed to the body, a plunger movable forward and backward within the body, and a solenoid coil that generates a magnetic circuit including the plunger and the core by an electric current externally supplied thereto, a bellows that is disposed in a pressure-sensing chamber formed between the valve section and the solenoid in the body, for sensing suction pressure of the variable displacement compressor to expand and contract, thereby being capable of urging the shaft in a direction of opening the valve section, a pressing force-transmitting member that is fixed to the plunger and at the same time configured to be capable of abutting against the bellows, the pressing force-transmitting member being capable of transmitting a force in a direction of compressing the bellows according to an attractive force applied to the plunger when the solenoid is energized, and urging means for urging the shaft in the direction of opening the valve section via the pressing force-transmitting member irrespective of an expanded or compressed state of the bellows.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1:
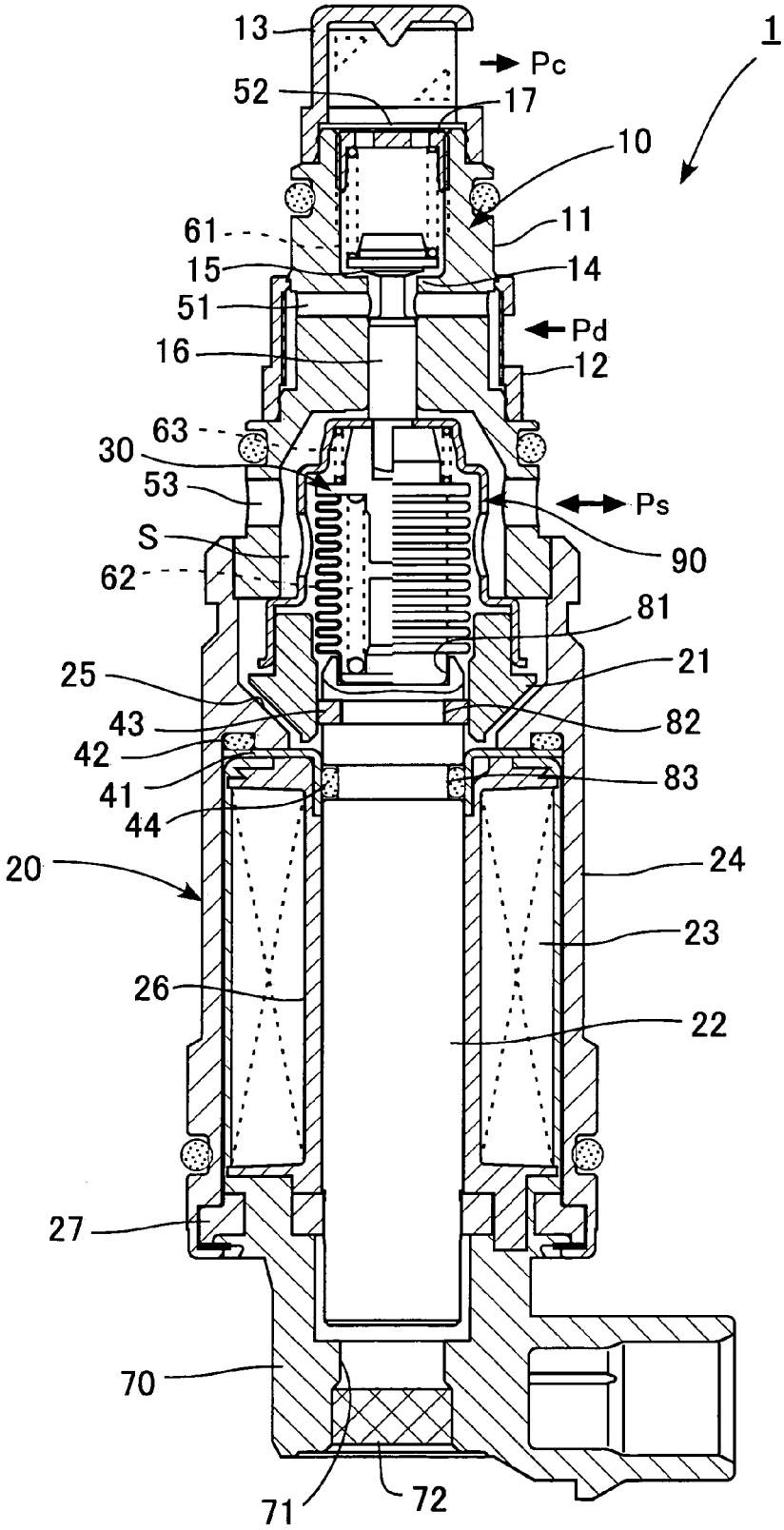
FIG. 1 is a cross-sectional view of the arrangement of a control valve for a variable displacement compressor, according to the present invention.
Figure 2:
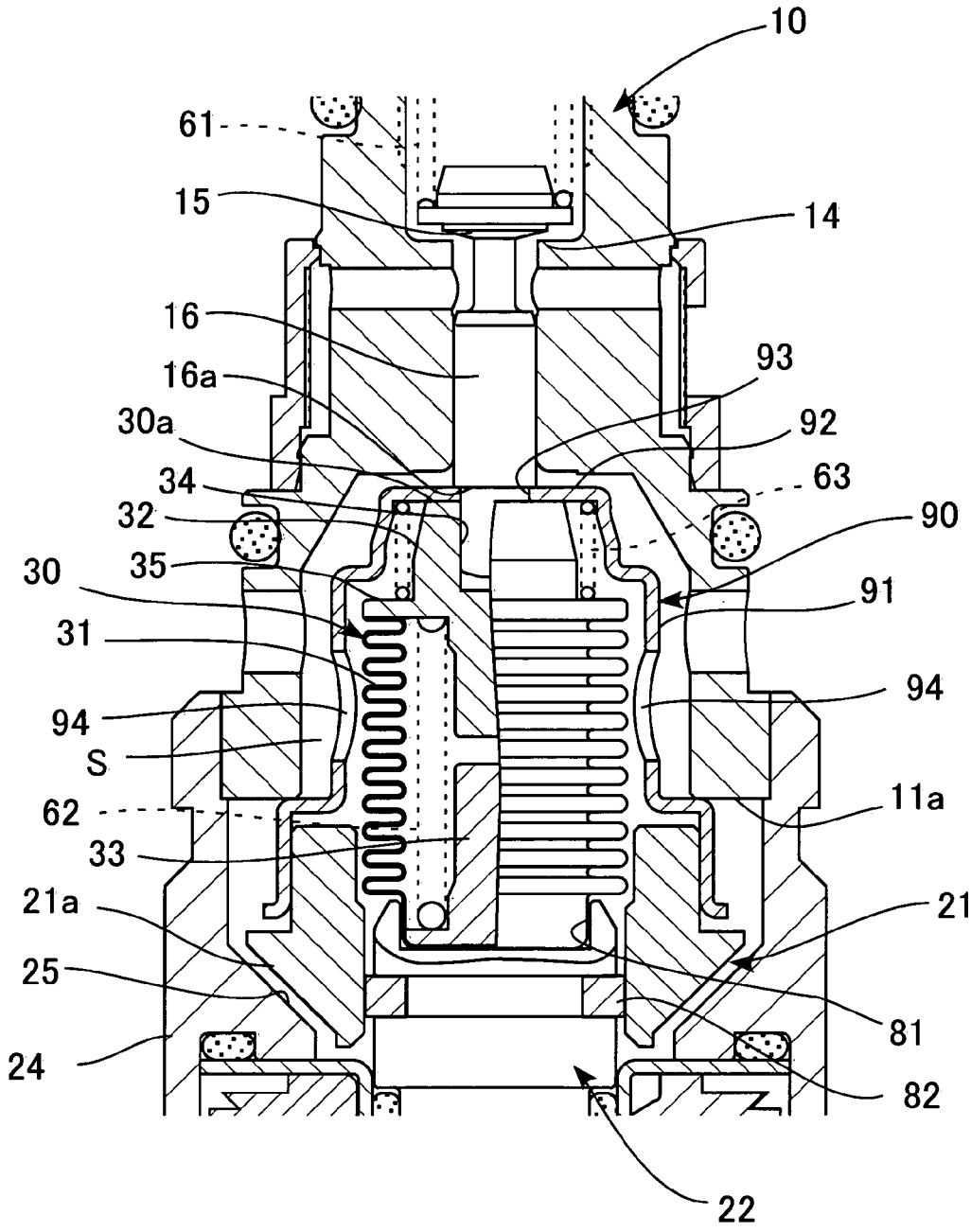
FIG. 2 is an enlarged view of the arrangement of a bellows and its vicinity as components of the control valve for a variable displacement compressor.

Hereinafter, an embodiment of the present invention will be described in detail with reference to the drawings. FIG. 1 is a cross-sectional view showing the arrangement of a control valve for a variable displacement compressor according to the present embodiment, and FIG. 2 is an expanded view showing the arrangement of a bellows and its vicinity, as components of the control valve for a variable displacement compressor.

As shown in FIG. 1, the control valve 1 for a variable displacement compressor (not shown) is formed by integrally assembling a valve section 10 used for opening and closing a refrigerant passage for allowing part of refrigerant discharged from the variable displacement compressor to flow into a crankcase thereof, and a solenoid 20 for controlling the flow rate of refrigerant passing through the valve section 10 by adjusting the valve lift of the valve section 10. A bellows 30 for causing the valve section 10 to be opened and closed is interposed between the valve section 10 and the solenoid 20.

The valve section 10 includes a body 11 formed with a side opening which communicates with a discharge chamber of the variable displacement compressor to form a port 51 for receiving discharge pressure Pd from the discharge chamber. The port 51 has a strainer 12 fixed to the periphery thereof. The port 51 communicates with a port 52 opening in the top of the body 11, via a refrigerant passage through the inside of the body 11. The port 52 is capped with a strainer 13, and communicates with the crankcase of the variable displacement compressor so as to introduce controlled pressure Pc in the crankcase.

In the refrigerant passage communicating between the port 51 and the port 52, a valve seat 14 is integrally formed with the body 11. In opposed relation to a side of the valve seat 14, from which the pressure Pc is introduced, a valve element 15 is axially disposed in a manner movable to and away from the valve seat 14. The valve element 15 extends downward as viewed in the figure through a valve hole and is formed integrally with a pressure-sensing piston 16 (shaft) which is axially movably held by the body 11. The discharge pressure Pd from the discharge chamber is introduced to a small-diameter portion connecting between the valve element 15 and the pressure-sensing piston 16. The outer diameter of the pressure-sensing piston 16 is set to be equal to the inner diameter of the valve hole forming the valve seat 14 such that the pressure-receiving area of the valve element 15 becomes equal to that of the pressure-sensing piston 16. As a result, a force with which the discharge pressure Pd acts on the valve element 15 in the upward direction as viewed in the figure is cancelled out by a force acting on the pressure-sensing piston 16 in the downward direction as viewed in the figure, to thereby prevent the control of the valve section 10 from being adversely affected by the high discharge pressure Pd.

The valve element 15 is urged by a spring 61 (first elastic member) in the valve-closing direction, and load on the spring 61 is adjusted by an adjustment screw 17 screwed into the port 52.

Further, a port 53 communicating with a suction chamber of the variable displacement compressor to receive suction pressure Ps is formed in a lower portion of the body 11 as viewed in the figure. The port 53 communicates with a pressure-sensing chamber S formed between the valve section 10 and the solenoid 20.

The solenoid 20 includes a plunger 21 and a core 22 arranged in the direction of opening and closing the valve element 15 of the valve section 10, a solenoid coil 23 for generating a magnetic circuit including the plunger 21 and the core 22 by an electric current externally supplied thereto, and a yoke 24 disposed such that it covers the solenoid coil 23 to form a case of the solenoid 20.

The yoke 24 has a hollow cylindrical body, with the lower end of the body 11 press-fitted into one end thereof and fixed thereat, and a housing 70 for a connector for receiving the externally supplied electric current is mounted at the other end thereof. Further, in the vicinity of the one end, the yoke 24 is formed with a plunger-opposed portion 25 which extends radially inward to form a surface opposed to the plunger 21. The plunger-opposed portion 25 is formed to have a tapered shape in which a portion thereof farther from the valve section 10 has a cross section which becomes thicker in a manner expanding radially inward.

The solenoid coil 23 is wound around a bobbin 26 which is in the form of a hollow cylinder, and the core 22 is disposed such that it extends through the bobbin 26. The outer periphery of the solenoid coil 23 is surrounded by the yoke 24.

The housing 70 comprises a portion for protecting the outer periphery of the bobbin 26, a portion for accommodating the end of the core 22, and a connector portion, which are integrally formed using a resin. Further, an annular plate 27 made of metal is inserted in the housing 70. The inner diameter of the plate 27 is slightly smaller than the inner diameter of the bobbin 26, thereby press-fitting a potion of the core 22 therein. The housing 70 and the yoke 24 are fastened to each other by caulking the other end of the yoke 24.

At an end of the bobbin 26 toward the valve section 10, a collar 41 formed of a non-magnetic substance is mounted. The collar 41 has a flange which extends radially outward from one end of a hollow cylindrical body thereof, and a hollow cylindrical portion thereof is press-fitted in a fitting groove formed at the end of the bobbin 26, with the flange being sandwiched between the plunger-opposed portion 25 and the bobbin 26. Hermeticity between the yoke 24 and the housing 70 is maintained by a packing 42 interposed between a groove formed in the plunger-opposed portion 25 and the flange.

The core 22 has a cylindrical body which has an axis common to the pressure-sensing piston 16 and the bellows 30, and an accommodation groove 81 is formed at an extreme end thereof toward the valve section 10, for accommodating an end of the bellows 30. Further, a guide groove 82 and a seal groove 83 having respective predetermined depths are circumferentially formed in a side surface thereof at respective locations near the accommodating groove 81, in a manner axially adjacent to each other with a predetermined spaced interval. A C-shaped guide member 43 made of a resin having a small friction resistance, such as polytetrafluoroethylene, is fitted in the guide groove 82 such that its outer peripheral surface is slightly protruded outward, and an O ring 44 is fitted in the seal groove 83, for maintaining hermeticity between the seal groove 83 and the inner peripheral surface of the collar 41. After being inserted into the bobbin 26, the core 22 is axially positioned by adjusting the press-fitted position of the plate 27. More specifically, the housing 70 is formed with a through hole 71 which communicates with the inside of the bobbin 26. In press-fitting the core 22, the core 22 is inserted into the bobbin 26 from an opposite side thereof to the housing 70, press-fitted to a position slightly shifted toward the housing 70 than a predetermined position with respect to the plate 27. Then, the core 22 is pushed toward the valve section 10 by a predetermined tool via the through hole 71 to make fine adjustment, whereby the core 22 is fixed to the predetermined position. After making fine adjustment, the through hole 71 is closed by inserting a rubber bush 72 therein.

As shown in FIG. 2, the plunger 21 has a hollow cylindrical body which is coaxially fitted on the end of the core 22 toward the bellows 30, and this body once expands radially outward at an approximate axially central portion thereof to form a tapered portion 21*a*, the outer diameter of which progressively decrease toward an extreme end thereof. The tapered portion 21*a* has a complementary shape to the plunger-opposed portion 25 of the yoke 24.

As described above, the tapered portion 21*a* of the plunger 21 and the plunger-opposed portion 25 of the yoke 24 are formed to have respective tapered shapes such that the opposed surfaces thereof are inclined, so that in the magnetic circuit there occurs the phenomenon of so-called magnetic leakage in which a radial component perpendicular to the axial direction as the proper attracting direction is caused. As a result, the attractive force generated when the tapered portion 21*a* and the plunger-opposed portion 25 are close to each other is reduced. Inversely, when the tapered portion 21*a* and the plunger-opposed portion 25 are distant from each other, even with the same distance between them, the axially shortest distance between the plunger 21 and the yoke 24 becomes smaller, which makes it possible to substantially reduce the magnetic gap. As a result, there is produced a larger attractive force between the opposed surfaces of the tapered portion 21*a* and the plunger-opposed portion 25 than an attractive force that would be generated when these surfaces are perpendicular to the axis of the core 22. As a result, it is possible to further increase the attractive force acting when the plunger 21 and the yoke 24 are distant from each other.

Connected to the opposite side of the plunger 21 to the tapered portion 21*a* is a pressing force-transmitting member 90 in the form of a capped hollow cylinder, for transmitting the attractive force applied to the plunger 21 to the bellows 30. More specifically, the pressing force-transmitting member 90 has a hollow cylindrical body 91 disposed in a manner surrounding the bellows 30, with one end thereof expanded so as to be press-fitted on the plunger 21 to a predetermined amount and fixed thereat. The outer diameter of the expanded part of the body 91 is slightly larger than the inner diameter of an opening at the lower end of the body 11. A stepped potion of the expanded part on the root side thereof is engaged with the lower end 11*a* (engaging part) of the body 11, whereby the motion of the pressing force-transmitting member 90 toward the valve section 10 is restricted. Further, the other end of the body 91 contracts to form an end wall 92, and an insertion hole 93 is formed through the center of the end wall 92 such that the end of the pressure-sensing piston 16 can be inserted therethrough. A portion of the end wall 92 close to the insertion hole 93 is, as described later, provides an abutment surface which can abut against an opposed surface 16*a* formed on a stepped portion of the pressure-sensing piston 16 facing toward the bellows 30, and a pressing surface which can abut against an opposed surface 30*a* of the bellows 30 facing toward the pressure-sensing piston 16. Further, a central portion of the body 91 of the pressing force-transmitting member 90 has a plurality of communication holes 94 formed therethrough, for communicating the inside and outside of body 91 with each other to thereby introduce the suction pressure Ps into the inside.

The bellows 30 defines a vacuum area within the body 31 which is capable of expanding and contracting, and is provided with stoppers 32 and 33 that close opposite axial ends of the bellows 30 and are disposed in opposed relation to each other inside the body 31. At an outer end face of the stopper 32 disposed toward the valve section 10, there is axially formed a circular recess 34 having a predetermined depth. The circular recess 34 has an inner diameter approximately equal to an outer diameter of the extreme end of the pressure-sensing piston 16, and the extreme end can be inserted therein. The bellows 30 can expand or contract, using the extreme end of the pressure-sensing piston 16 inserted in the circular recess 34 as a guide.

On the other hand, the stopper 33, which is provided on an opposite side to the valve section 10, is formed such that an outer end face thereof is fitted in the accommodation groove 81 of the above-described core 22 and fixed thereat. A spring 62 urging the bellows 30 in the expanding direction is disposed inside the bellows 30, thereby enabling the bellows 30 to expand when the suction pressure Ps is low. It should be noted that even if the force is applied to the bellows 30 in the contracting direction, the two stoppers 32 and 33 are brought into contact with each other to thereby prevent the bellows 30 from being further compressed.

The stopper 32 is formed with a flange 35 which extends radially outward, and a spring 63 (second elastic member)

urging the pressing force-transmitting member 90 toward the valve section 10 is interposed between the flange 35 and the end wall 92 of the pressing force-transmitting member 90. The spring 63 has a larger spring force than the spring 61, and a smaller spring force than the spring 62. Therefore, when the solenoid 20 is not energized, as shown in FIG. 2, the spring 63 can push the pressure-sensing piston 16 upward until the expanded part of the pressing force-transmitting member 90 is brought into contact with the lower end 11*a* of the body 11, whereby the valve element 15 can be held in the fully-open position.

As described above, the present control valve 1 is configured such that the pressing force-transmitting member 90 is brought into engagement with the lower end of the body 11. Therefore, a setting of load of the spring 62 can be changed by adjusting the press-fitted amount (position) of the core 22 into the solenoid 20 (adjusting means), and a setting of load of the spring 63 can be changed by adjusting the press-fitted amount (position) of the pressing force-transmitting member 90 onto the plunger 21 (second adjusting means).

In the arrangement described above, the whole body of the control valve 1 for a variable displacement compressor is formed by the body 11 of the valve section 10, the yoke 24 of the solenoid 20, and the housing 70. The magnetic circuit of the solenoid 20 surrounding the solenoid coil 23 is formed by the plunger 21, the core 22, the plate 27, the yoke 24, and so forth. In other words, when the solenoid 20 is energized, the magnetic circuit is formed via the opposed surfaces of the plunger 21 and the yoke 24 opposed in the moving direction (axial direction) of the plunger 21. At this time, the opposed surfaces of the plunger 21 and the core 22 are parallel to the axis so that there is little change in the attractive force between the core 22 and plunger 21 when the plunger 21 is moved, and hence the axial movement of the plunger 21 is hardly adversely affected.

Figure 3:
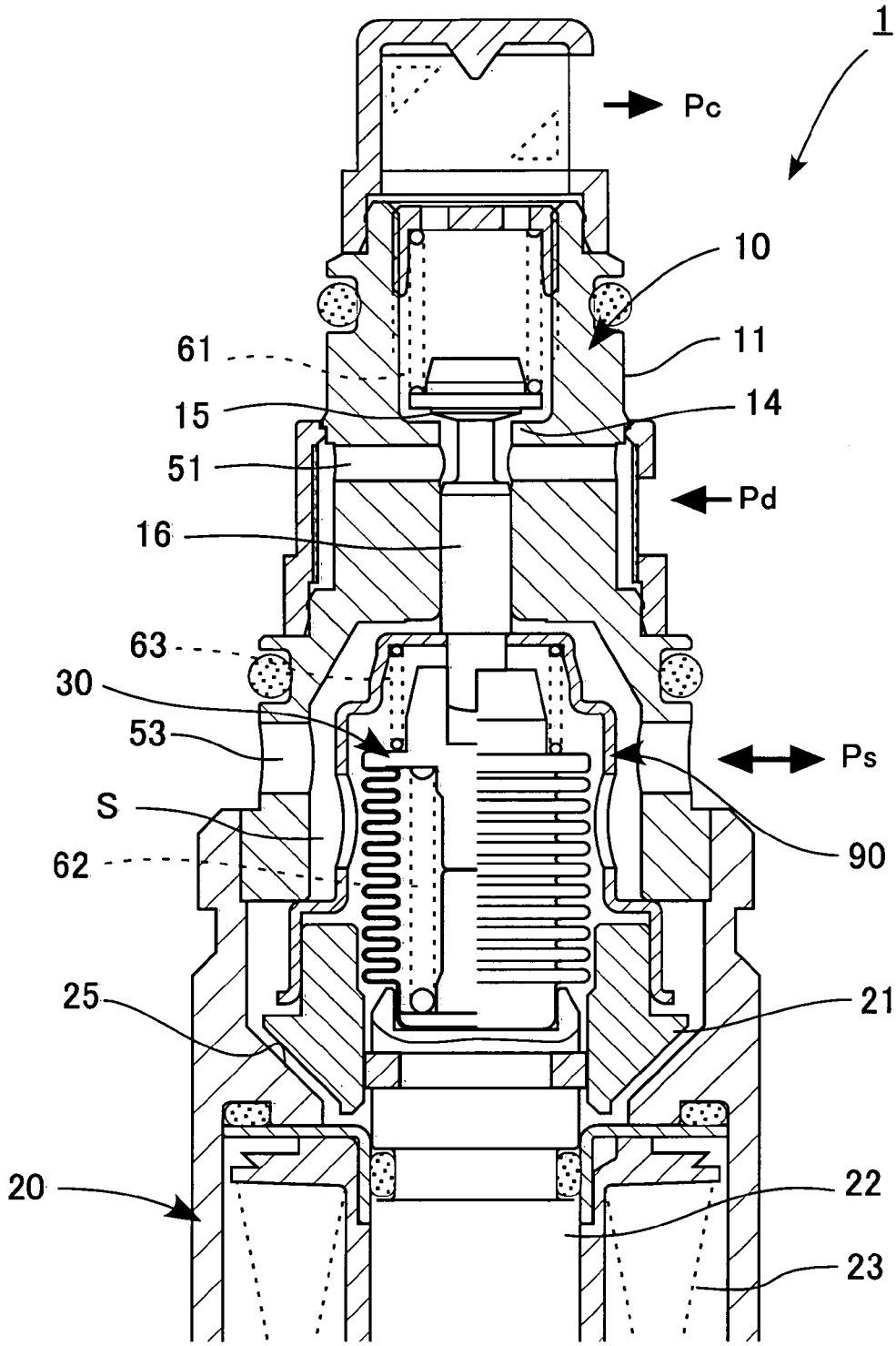
FIG. 3 is a view useful in explaining the operations of essential components of the control valve for a variable displacement compressor.
Figure 4:
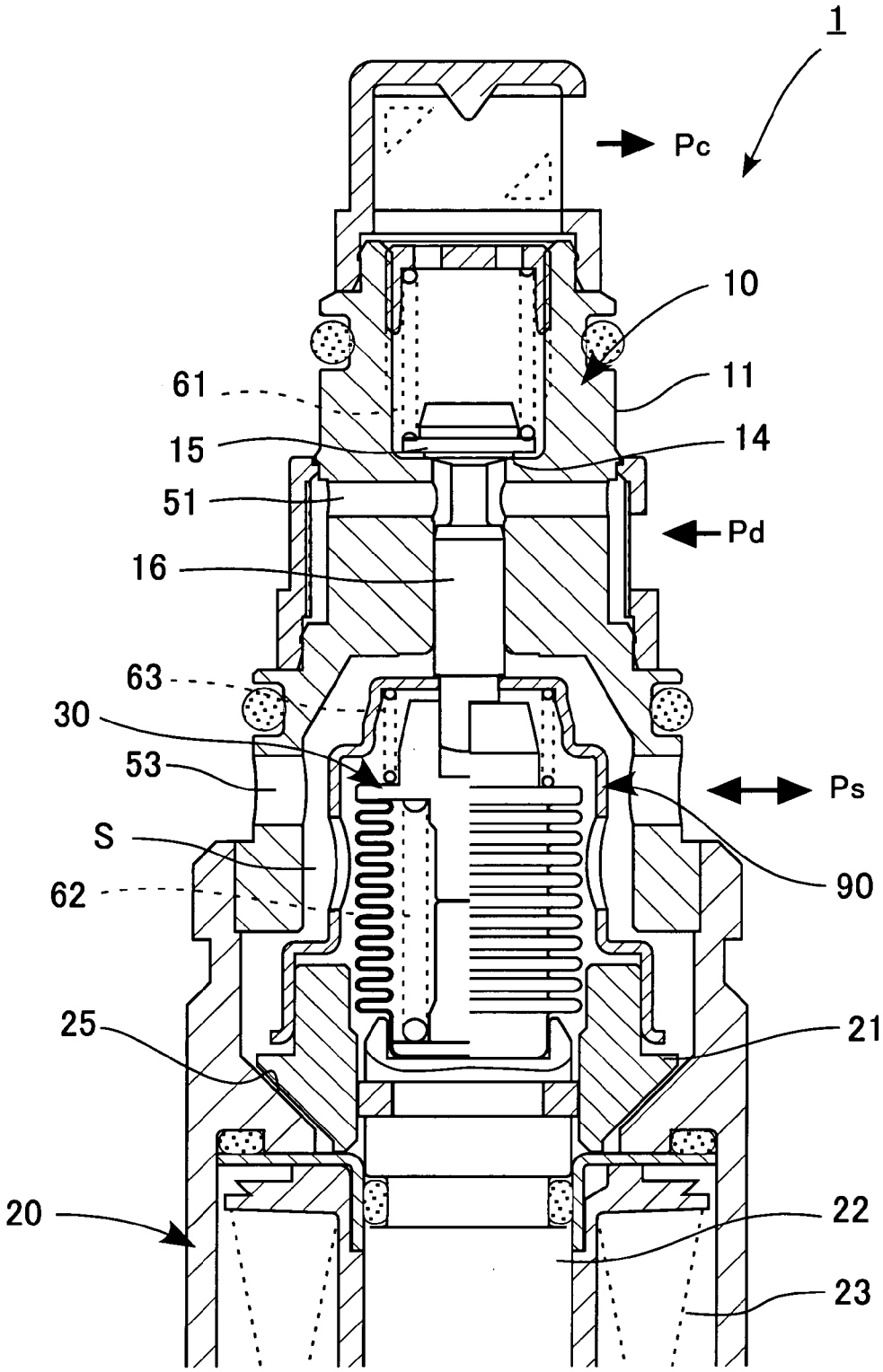
FIG. 4 is a view useful in explaining the operations of essential components of the control valve for a variable displacement compressor.
Figure 5:
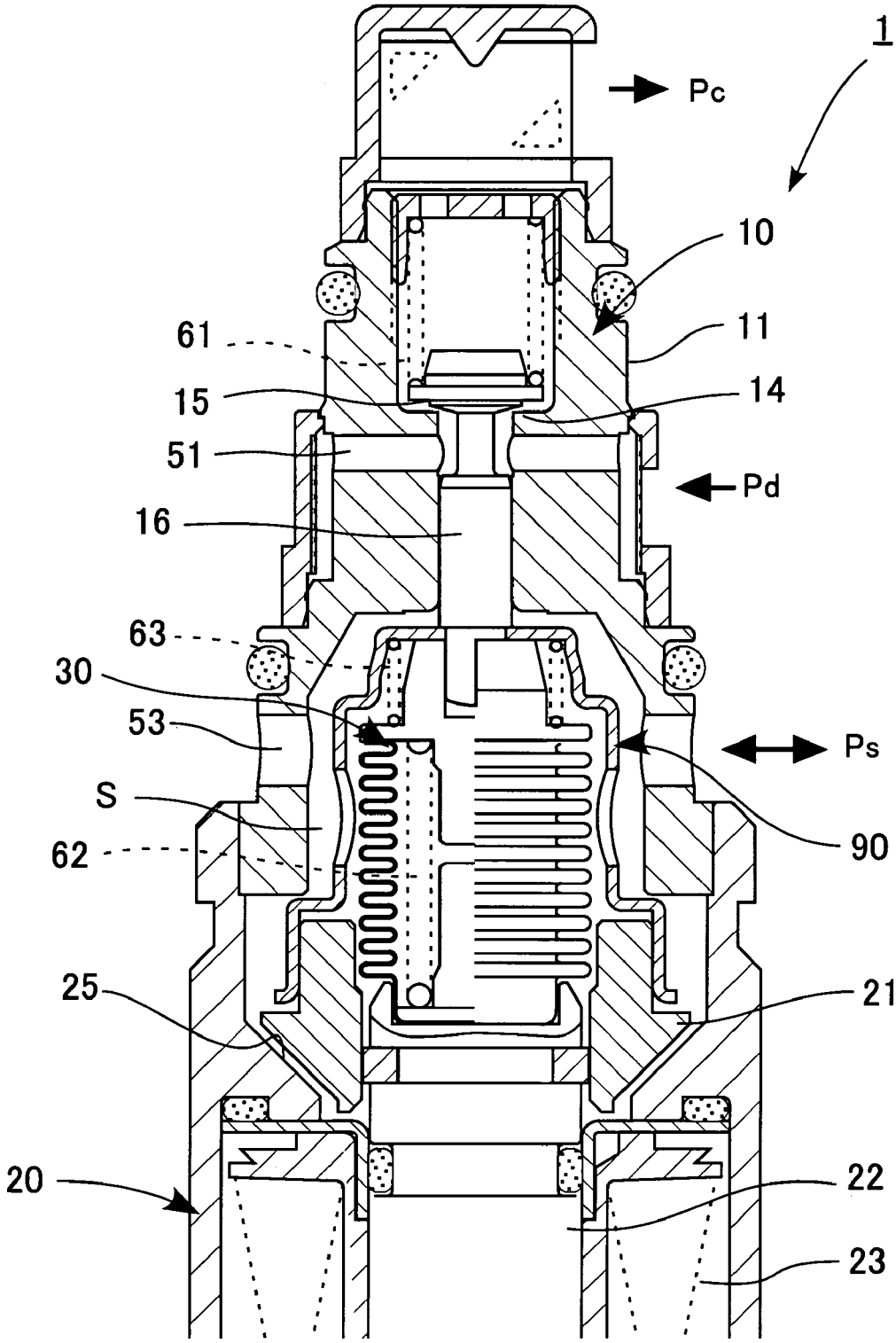
FIG. 5 is a view useful in explaining the operations of essential components of the control valve for a variable displacement compressor.

Next, a description will be given of the operation of the control valve 1 for a variable displacement compressor. FIG. 3 to FIG. 5 are views useful in explaining the operations of essential components of the control valve 1.

The control valve 1 illustrated in FIG. 3 is in a state in which the solenoid 20 is not energized and the suction pressure Ps is high, that is, a state in which the air conditioner is not in operation. Since the suction pressure Ps is high, the bellows 30 is in a compressed state. At this time, the attractive force does not act on the plunger 21, so that the pressing force-transmitting member 90 is urged upward as viewed in the figure, by the spring 63, so as to be moved away from the bellows 30, and hence urges the valve element 15 toward its fully open position via the pressure-sensing piston 16. Therefore, even when the rotational shaft of the variable displacement compressor is being driven for rotation by the engine in the above state, the variable displacement compressor is operated with the minimum displacement.

Now, when the maximum control current is supplied to the solenoid coil 23 of the solenoid 20, as in the case of the automotive air conditioner having been started, as shown in FIG. 4, the attractive force acts on the plunger 21 to cause the pressing force-transmitting member 90 to move downward, so that the urging force acting on the pressure-sensing piston 16 from below is canceled out. This allows the spring 61 to push the valve element 15 downward, thereby causing the valve element 15 to be seated on the valve seat 14, to fully close the valve section 10. This blocks off the passage extending from the discharge chamber to the crankcase, so that the variable displacement compressor is promptly shifted into the operation with the maximum capacity.

When the variable displacement compressor further continues to operate with the maximum capacity to make the suction pressure Ps from the pressure-sensing chamber S low enough, as shown in FIG. 5, the bellows 30 senses the suction pressure Ps to expand and thereby attempts to move upward as viewed in the figure. At this time, if the control current supplied to the solenoid coil 23 of the solenoid 20 is decreased according to the set temperature of the air conditioner, the pressure-sensing piston 16, the pressing force-transmitting member 90, and the bellows 30 move in unison upward as viewed in the figure to respective positions where the suction pressure Ps, the loads of the springs 61, 62, and 63, and the attractive force of the solenoid 20 are balanced. This causes the valve element 15 to be pushed upward to move away from the valve seat 14, thereby being set to a predetermined valve lift. Therefore, refrigerant at the discharge pressure Pd is introduced into the crankcase at a flow rate controlled to a value dependent on the valve lift, whereby the variable displacement compressor is shifted to an operation with the displacement corresponding to the control current.

At the time, if the control current supplied to the solenoid coil 23 of the solenoid 20 is constant, the bellows 30 senses the suction pressure Ps to thereby control the valve lift of the valve section 10. For example, when the refrigeration load increases to make the suction pressure Ps high, the bellows 30 contracts to be displaced downward as viewed in the figure, so that the valve element 15 is also moved downward to decrease the valve lift of the valve section 10, causing the variable displacement compressor to operate in a direction of increasing the displacement thereof. On the other hand, when the refrigeration load decreases to make the suction pressure Ps low, the bellows 30 expands to be displaced upward as viewed in the figure to increase the valve lift of the valve section 10, causing the variable displacement compressor to operate in a direction of decreasing the displacement. Thus, the control valve controls the displacement of the variable displacement compressor such that the suction pressure Ps is made constant.

As described above, in the control valve 1 for a variable displacement compressor, the bellows 30 is disposed between the pressure-sensing piston 16 and the core 22 in the pressure sensing chamber S, and further, the pressing force-transmitting member 90 which is fixed to the plunger 21 is interposed between the pressure-sensing piston 16 and the bellows 30. Then, the spring 63 which urges the pressing force-transmitting member 90 toward the valve section 10 is disposed between the pressing force-transmitting member 90 and the bellows 30.

Therefore, when the suction pressure Ps is low, the bellows 30 expands to be connected to the pressure-sensing piston 16 via the pressing force-transmitting member 90, so that the valve section 10 and the bellows 30 can be moved in unison. On the other hand, when the suction pressure Ps is high, the bellows 30 contracts. However, the spring 63 holds the pressing force-transmitting member 90 in a state urged toward the valve section 10, and hence the valve section 10 can operate independently of the bellows 30. That is, if the solenoid 20 is not energized, even when the suction pressure Ps is high, the valve element 15 is pushed upward via the pressing force-transmitting member 90 and the pressure-sensing piston 16 to make the valve section 10 fully open, which enables the minimum operation of the compressor to be maintained.

Further, the core 22 and the pressing force-transmitting member 90 are disposed along the axis such that the bellows 30 is sandwiched between them, and the pressing force-transmitting member 90 is brought into engagement with the lower end 11*a* of the body 11. By adjusting the axial press-fitted position of the core 22, the spring force of the spring 62 in the bellows 30 is adjusted. Therefore, as to the adjustment of the elastic force (set value) of the bellows 30 of the control valve 1 to be exerted when it is expanded, there is no need to provide a mechanism designed specifically for the adjustment, such as a shaft or a screw mechanism for pressing the bellows, but the adjustment can be realized at low costs.

Although the preferred embodiment of the present invention has been described heretofore, the present invention is by no means limited to the specific embodiment thereof, but various modifications and alterations can be made thereto without departing the spirit and scope of the present invention.

For example, although in the above-described embodiment, as shown in FIG. 1, the guide groove 82 is formed at the extreme end of the core 22, and the guide member 43 having a square cross section and a small frictional resistance is disposed therein, so as to enable the plunger 21 to slide smoothly, this is not limitative, but another arrangement than this is also possible.

Figure 6:
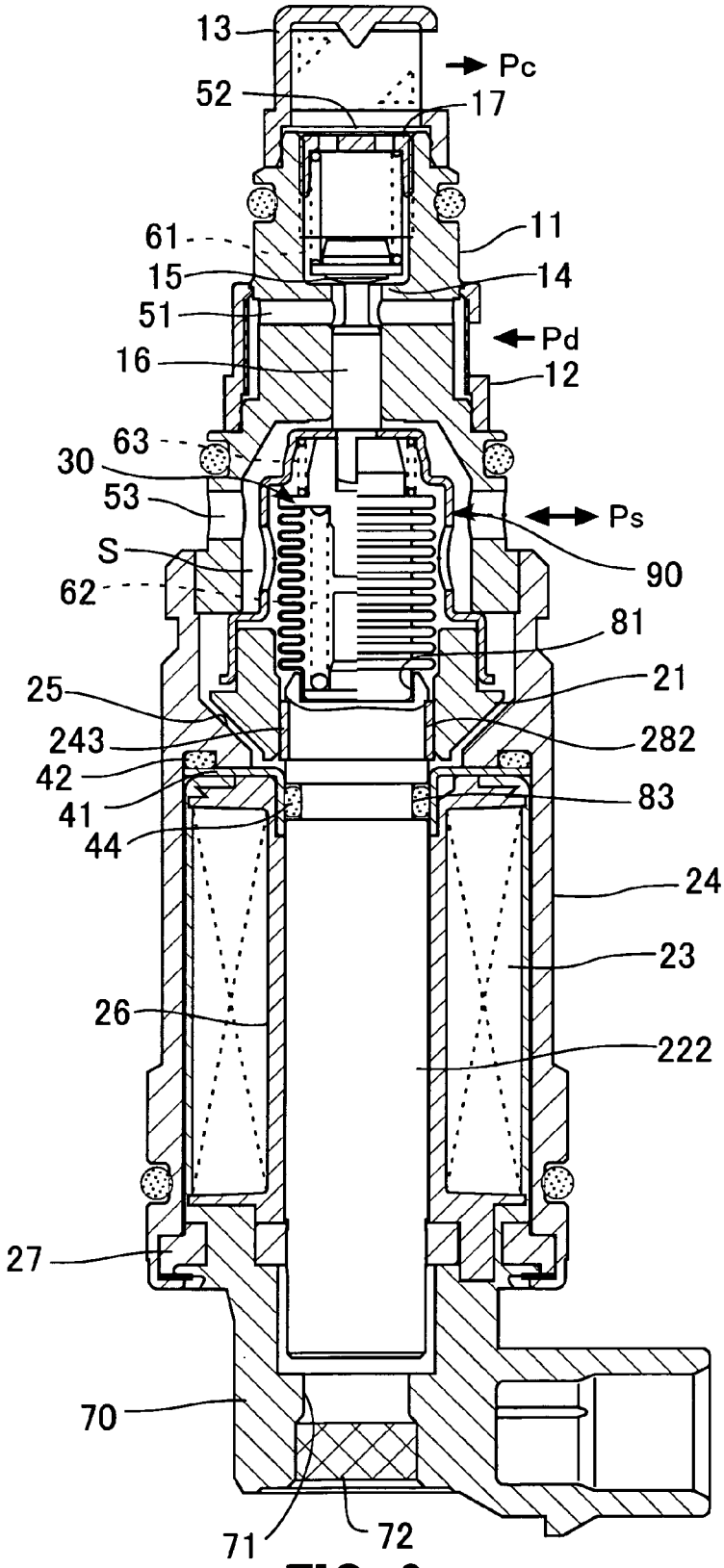
FIG. 6 is a cross-sectional view of the arrangement of a control valve for a variable displacement compressor, according to a variation.

For example, as in a variation in FIG. 6, a shallow groove 282 can be circumferentially formed in an extreme end of a core 222, and a small hollow cylindrical sleeve 243 (anti-abrasion means), made of a resin material, such as polytetrafluoroethylene, may be disposed in the groove 282.

With this arrangement, the thickness of the anti-abrasion means can be reduced, whereby a magnetic gap caused thereby between the core 22 and plunger 21 can be reduced.

It should be noted that the guide member 43 and the sleeve 243 described above can be mounted not on the core 22 or 222 but on the plunger 21 by forming a groove therein.

Figure 7:
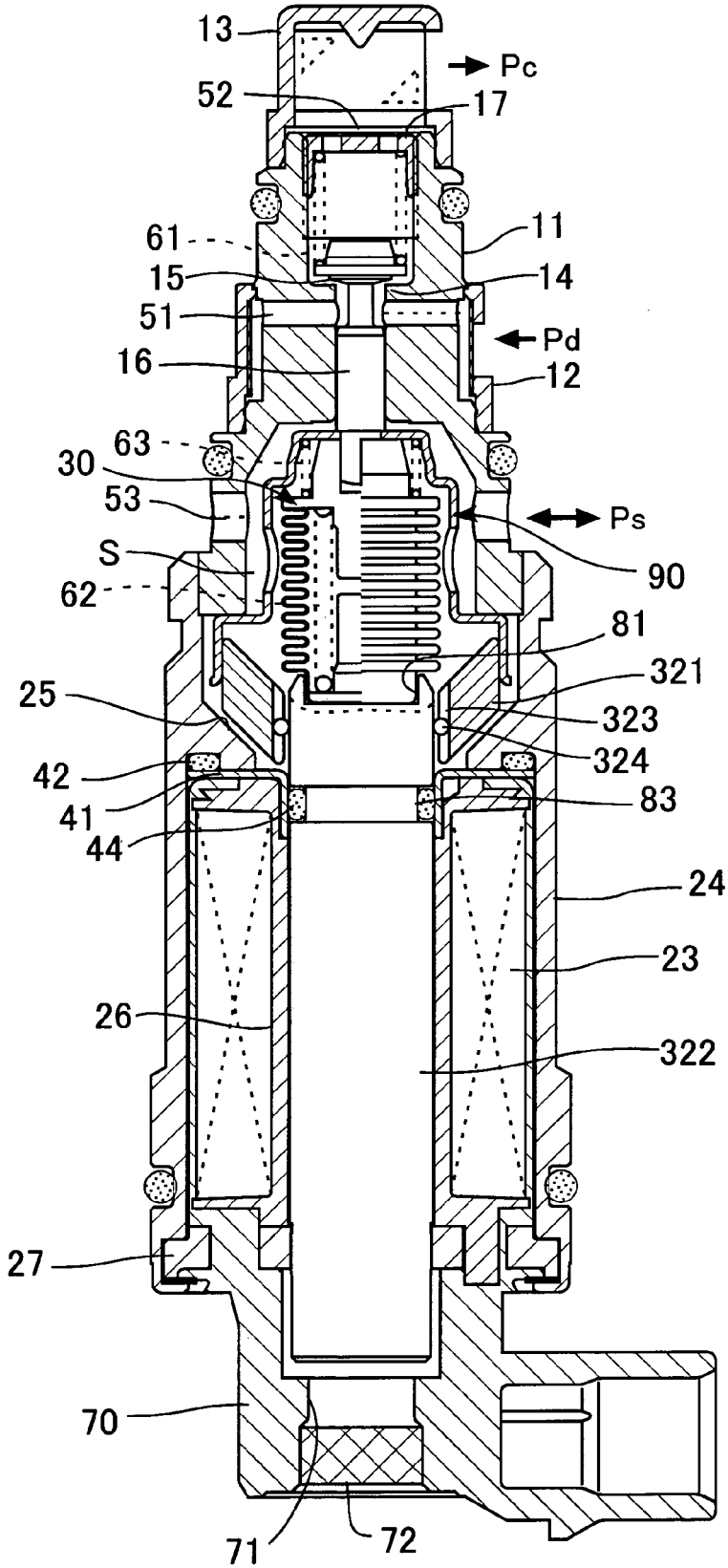
FIG. 7 is a cross-sectional view of the arrangement of a control valve for a variable displacement compressor, according to a variation.

Alternatively, as in another variation shown in FIG. 7, an arrangement is also possible in which a ball bearing structure is applied to the inner peripheral surface of a plunger 321, so as to enable the plunger 321 to slide on the flat outer peripheral surface of the extreme end of a core 322.

More specifically, the above arrangement can be realized by forming a tapered annular member which is inclined with the respect to the axis in a radially inward direction, by so-called fine blanking processing or the like, then forming narrow grooves 323 in the inner peripheral surface of the annular member such that they extend axially at circumferentially predetermined spaced intervals, and disposing balls 324 in the narrow grooves 323. Although not shown explicitly, the narrow grooves 323 of the member can be prevented from dropping off the balls 324 e.g. by caulking the axial ends thereof.

With the above-described arrangement, the plunger 321, and hence the pressing force-transmitting member 90 can be caused to slide smoothly, and at the same time it is possible to prevent or suppress abrasion of the plunger 321 and the core 322 to thereby increase their lives. In this variation as well, a setting value of load of the spring 63 can be changed by adjusting the press-fitted amount (position) of the pressing force-transmitting member 90 with respect to the plunger 321.

Further, although in the above-described embodiment, an example of the arrangement of the pressing force-transmitting member 90 is shown in the FIG. 2, insofar as the member 90 is configured such that it can press each of the pressure-sensing piston 16 and the bellows 30, based on the motion of the plunger 21, any other arrangement than the illustrated example can be employed. Further, the pressing force-transmitting member 90 may be formed integrally with the plunger 21.

Further, although in the above-described embodiment, the arrangement is shown in which the extreme end of the pressure-sensing piston 16 is inserted into the circular recess 34 in the stopper 32 of the bellows 30, this is not limitative, but inversely a groove may be formed in the pressure-sensing piston 16, and the extreme end of the bellows 30 may be inserted in the groove. Alternatively, the pressure-sensing piston 16 and the bellows 30 may have respective end faces thereof simply brought into contact with each other via the pressing force-transmitting member 90, instead of being fitted to each other. Further, without forming the insertion hole 93 through the end wall 92 of the pressing force-transmitting member 90, the end wall of the pressing force-transmitting member 90 may be interposed between the pressure-sensing piston 16 and the bellows 30.

Further, although in the above-described embodiment, the valve element 15 and the pressure-sensing piston 16 are integrally formed with each other, the valve element may be configured e.g. by a ball valve or the like such that the ball valve can be supported by a shaft in place of the pressure-sensing piston 16.

According to the control valve for a variable displacement compressor of the present invention, when the solenoid is not energized, the shaft is urged in the valve-opening direction via the pressing force-transmitting member independently of the expanding and contracting motion of the bellows. As a result, even when the suction pressure is high, the valve section can be fully opened by stopping energization of the solenoid to thereby maintain the minimum operation of the compressor.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A control valve for a variable displacement compressor, the control valve being mounted in the variable displacement compressor, for varying a discharge amount of refrigerant by controlling a pressure in a crankcase of the compressor, comprising:

a body that has refrigerant passages formed therethrough;

a valve section that includes a valve element that moves to and away from a valve seat formed in the body so as to be operable when part of refrigerant discharged from the variable displacement compressor is allowed to flow into the crankcase, to adjust a flow rate of the part of refrigerant, and a shaft axially slidably supported in the body and at the same time axially supporting the valve element;

a solenoid that includes a core fixed to the body, a plunger movable forward and backward within the body, and a solenoid coil that generates a magnetic circuit including the plunger and the core by an electric current externally supplied thereto;

a bellows that is disposed in a pressure-sensing chamber formed between the valve section and the solenoid in the body, for sensing suction pressure of the variable displacement compressor to expand and contract, thereby being capable of urging the shaft in a direction of opening the valve section;

a pressing force-transmitting member that is fixed to the plunger and at the same time configured to be capable of abutting against the bellows, the pressing force-transmitting member being capable of transmitting a force in a direction of compressing the bellows according to an attractive force applied to the plunger when the solenoid is energized;

urging means for urging the shaft in the direction of opening the valve section via the pressing force-transmitting member irrespective of an expanded or compressed state of the bellows, and adjust means for adjusting a position where the plunger and the pressing force-transmitting member are fixed, thereby being capable of setting an axial position of the pressing surface when the solenoid is energized;

wherein the body has an engaging part formed thereon for being engaged with the pressing force-transmitting member to stop motion toward the valve section by the urging means irrespective of an expanded or compressed state of the bellows when the solenoid is not energized, and the motion of the shaft in a direction of closing the valve section is restricted by the pressing force-transmitting member engaged with the engaging part, so that the valve section is held in an open state;

wherein the urging means comprises:

a first elastic member that urges the valve element in a valve-closing direction; and a second elastic member that is disposed between the pressing force-transmitting member and the bellows, for urging the pressing force-transmitting member in the direction of opening the valve section, the second elastic member having a larger elastic force than the first elastic member, and wherein when the solenoid is energized, the pressing force-transmitting member is moved in the direction of compressing the bellows against an urging force of the second elastic member, by motion of the plunger;

wherein the pressing force-transmitting member comprises:

a body that is fixed to the plunger, and disposed in a manner surrounding the bellows;

a pressing surface that can abut against a surface of the bellows opposed to the shaft; and an abutment surface that can abut against a surface of the shaft opposed to the bellows, and wherein when the solenoid is energized, the pressing force-transmitting member operates to urge the bellows in a direction away from the valve section, via the pressing surface.

2. The control valve according to claim 1, comprising second adjust means for adjusting a position of the bellows while supporting the bellows on a side thereof opposite to the shaft, so as to set a reference value of the elastic force of the bellows in a state of the pressing force-transmitting member being engaged with the engaging part.

3. The control valve according to claim 2, wherein the bellows is supported by one axial end face of the core, and wherein the second adjust means sets the reference value of the elastic force, by adjusting an axial position of the core with respect to the body of the control valve.

4. The control valve according to claim 1, wherein the solenoid comprises:

the core having a cylindrical shape and having an axis common to the shaft and the bellows, the solenoid coil disposed in a manner surrounding the core;

a yoke that further surrounds the solenoid coil to form a part of the magnetic circuit; and the plunger that is configured to be coaxially inserted around an end of the core on a side thereof toward the bellows such that the plunger is axially displaceable relative to the core, the plunger having a hollow cylindrical shape that has an axial surface opposed to an axial surface of the yoke, and wherein the control valve is configured such that the attractive force is axially generated between the plunger and the yoke.

5. The control valve according to claim 4, wherein anti-abrasion means is circumferentially provided on one of the core and the plunger, and wherein the plunger is configured so as to slide with respect to the core via the anti-abrasion means.

6. The control valve according to claim 5, wherein the anti-abrasion means comprises a ball bearing.

7. The control valve according to claim 4, wherein the opposed surfaces of the plunger and the yoke are formed to have respective tapered shapes complementary to each other.

* * * * *